US010751777B2

(12) United States Patent
Streen et al.

(10) Patent No.: US 10,751,777 B2
(45) Date of Patent: Aug. 25, 2020

(54) HAND-HELD PUNCH TOOL

(71) Applicant: Edgy Tools LLC, Chandler, AZ (US)

(72) Inventors: David Streen, Chandler, AZ (US); Marino Cecchi, Sun City West, AZ (US)

(73) Assignee: EDGY TOOLS LLC, Chandler, AZ (US)

( * ) Notice: Subject to any disclaimer, the term of this patent is extended or adjusted under 35 U.S.C. 154(b) by 683 days.

(21) Appl. No.: 15/213,229

(22) Filed: Jul. 18, 2016

(65) Prior Publication Data

US 2017/0014883 A1 Jan. 19, 2017

Related U.S. Application Data

(60) Provisional application No. 62/194,145, filed on Jul. 17, 2015.

(51) Int. Cl.

| | |
|---|---|
| ***B21D 1/06*** | (2006.01) |
| ***B25D 1/00*** | (2006.01) |
| *B25B 23/16* | (2006.01) |

(52) U.S. Cl.

CPC ..... *B21D 1/065* (2013.01); *B25D 1/00* (2013.01); *B25B 23/16* (2013.01)

(58) Field of Classification Search

CPC ..... B21D 1/065; B25B 23/16; B25B 23/00; B25F 1/02; B25D 1/00; B25D 1/02; B25D 2250/065; B25D 2250/295; B25D 5/00

USPC ..... 81/177.1, 177.3, 439, 20–27, 489–492; 7/143–147

See application file for complete search history.

(56) References Cited

U.S. PATENT DOCUMENTS

| | | | | |
|---|---|---|---|---|
| 1,648,354 | A | 11/1927 | Lied | |
| 1,980,087 | A | 11/1934 | Rast | |
| 5,704,129 | A | 1/1998 | Glesser | |
| 6,023,997 | A * | 2/2000 | Willis | B25D 1/02 81/20 |
| 6,922,864 | B2 * | 8/2005 | Clarke | B25G 1/085 7/143 |
| 8,595,874 | B1 * | 12/2013 | Knapp | B25F 1/006 7/138 |
| 2004/0123703 | A1 | 7/2004 | Hsien | |
| 2004/0129119 | A1 | 7/2004 | Clarke et al. | |

(Continued)

FOREIGN PATENT DOCUMENTS

BE 1011505 A6 10/1999

OTHER PUBLICATIONS

PCT/US2016/042856, International Search Report and Written Opinion, dated Oct. 17, 2016, 7 pages.

*Primary Examiner* — Pradeep C Battula

(74) *Attorney, Agent, or Firm* — Eleanor Musick; Musick Davison LLP

(57) ABSTRACT

A punch tool includes a body having a contoured profile configured for holding in a user's hand. The body includes at least one opening for receiving a user's digits and the contoured profile has at least one extension configured for contact with another of the user's digits. A strike portion for applying an external force is located at an upper portion of the body centered on a force line extending through the body. An impact portion is located at a lower portion of the body concentric with the force line and has an end tip configured to focus at least a portion of the external force to a work surface.

17 Claims, 5 Drawing Sheets

(56) References Cited

U.S. PATENT DOCUMENTS

| | | | | |
|---|---|---|---|---|
| 2007/0028727 | A1* | 2/2007 | Schiller | B25B 13/14 81/177.3 |
| 2015/0197022 | A1 | 7/2015 | Pelton | |

* cited by examiner

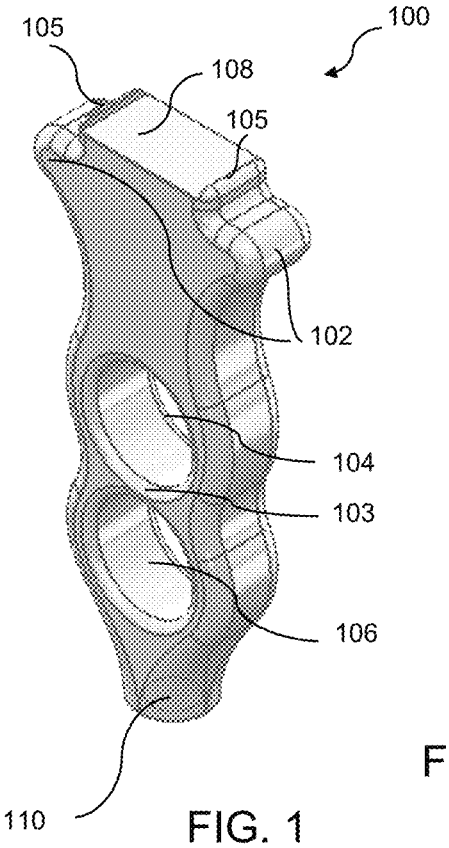
FIG. 1
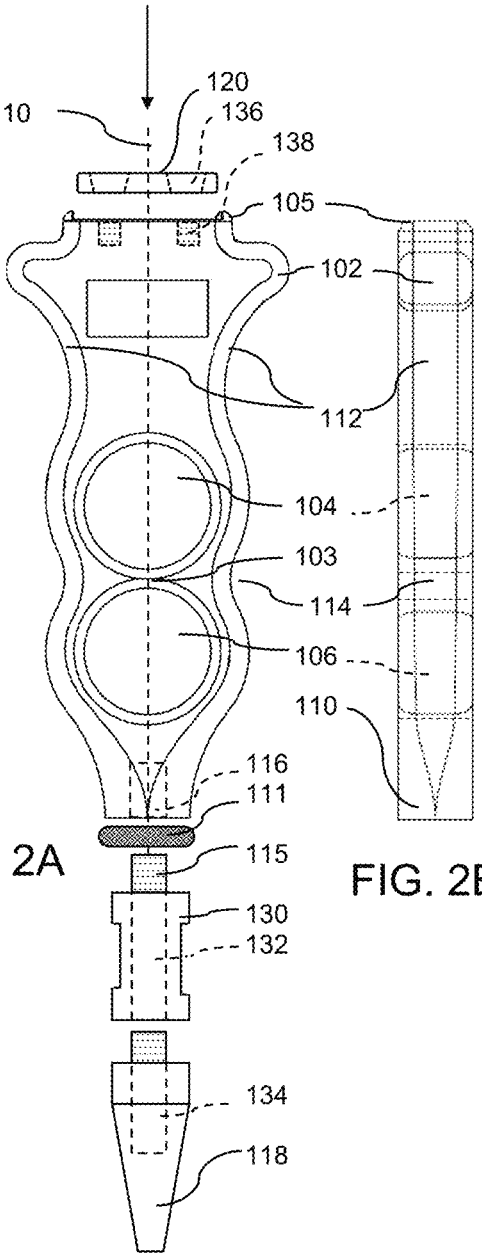
FIG. 2A
FIG. 2B
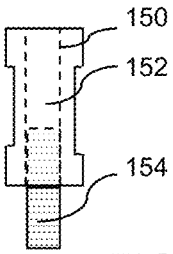
FIG. 2C

HAND-HELD PUNCH TOOL

RELATED APPLICATIONS

This application claims the benefit of the priority of U.S. Provisional Application No. 62/194,145, filed Jul. 17, 2015, which is incorporated herein by reference in its entirety.

FIELD OF THE INVENTION

The present invention relates to a hand-held tool for use in transferring force to a surface, and more specifically to a punch tool with an improved grip.

BACKGROUND OF THE INVENTION

Removing dents in automobile panels historically has been a crude application of hammer blows using various shaped anvils and intermediary impact-transfer shapes known as "spoons," and/or drilling through the dent and attaching a puller or slide hammer. Failing to achieve complete success with these techniques, the dent is frequently finished by filling with epoxy-like plastics. The resulting work leaves a damaged or unpainted surface that requires repainting of the panel and all the attendant problems of matching colors, surface characteristics, etc., followed over time, by differential fading and weathering.

More recently, especially with the use of the thinner materials in automobile body panel construction, a process of gently tapping and pushing from the back side has been developed. Because the straightening process itself does not damage the exterior surface, such techniques are generally known as "paintless dent repair."

Paintless dent repair is a highly skilled art and requires a large variety of tool tips at the working end of the tool. In addition to a variety of tips, a variety of end curves, shaft lengths, and shaft diameters and/or shapes are needed. In most cases, the dent can be massaged out without disassembly of the auto body. In order to gain access without significant disassembly, some tools need to be long and thin to reach the dent through existing openings, or through opening that can be made without noticeable damage. The long slender design of most of the tools predicates the use of very high quality tempered steel. Because a dent can occur in so many different locations, the artisan requires a large set of tools, some differing only by the orientation of the handle relative to the working tip.

The space within a door panel, a common place where dings and other small dents may occur, is especially crowded with window glass, window mechanisms, locks, motors, structural bracing, etc. The crowding within doors presents even more of a challenge as additional gadgetry (e.g., sensors and accompanying circuitry), safety features, and further structural reinforcement are added with each successive model of automobiles.

Most of the tools in the sets available to the trade have handles formed by bending the shank stock into loops or other shapes for handling. Such handles are light weight and somewhat flexible, features that may not always be optimal for the work to be performed. Furthermore, a formed handle may require a substantial length, e.g., 20 inches, of steel rod. This can be limiting when attempting to perform repairs in tight spaces and/or at an awkward angle.

For purposes of auto body dent repair, tools must be capable of repairing a wide variety of dents, in a wide variety of locations, in a wide variety of vehicles with differing option packages, configuration and equipment. The auto body dent repair tool should be easily re-configurable and adjustable to extend into a variety of difficult-to-reach areas. Additionally, the auto body dent repair tool would preferably adaptable for use with a wide variety of interchangeable tips.

Users of punch and punch-like tools in other fields, for example, carpentry, woodworking and leather working, frequently experience similar challenges to those in the dent repair field. Tight spaces and awkward angles can make it difficult to position and securely grip the tool while applying the necessary force to achieve the desired effect, e.g., forming a hole or recess, or shaping a surface. Accordingly, the need remains for a punch tool that is easily gripped, minimizes risk of injury to the user and is configurable to facilitate access to work surface in a variety of different situations. The present invention is directed to such a need.

BRIEF SUMMARY

In an exemplary embodiment, a punch tool includes a body configured for holding in a user's hand, a strike portion having a surface for applying an external force, an impact portion configured for contacting the work surface, and at least one opening configured for insertion of a user's digit (finger or thumb). Tapered extensions further facilitate gripping with the user's hand. The strike portion may include a recessed area for receiving a strike pad, which may be permanently or removably attached to the strike portion. The strike pad may be formed from a resilient material such as an elastomer, a polymer or plastic, wood, cork, or it may be a hard material, i.e., a metal plate, such as steel. A force line extends between the strike portion and the impact portion, so that application of a force to the strike portion transfers force to the impact portion. The impact portion may be a tip removably attached to the body. The tip may be cylindrical, conical, pointed, rounded, or some combination thereof, depending on the desired use. In some embodiments, the force line extends through the at least one hole in the body, while in other embodiments, the force line is offset from the at least one hole.

In one aspect of the invention, a punch tool includes a body having a contoured profile configured for holding in a user's hand, the body having at least one opening for receiving a user's digits, the contoured profile comprising at least one extension configured for contact with another of the user's digits; a strike portion disposed at an upper portion of the body centered on a force line extending through the body, the strike portion comprising a material configured for striking with an external force; and an impact portion disposed at a lower portion of the body, the impact portion concentric with the force line and having an end tip configured to focus at least a portion of the external force to a work surface. In some embodiments, the at least one opening is centered on the force line, while in other embodiments the at least one opening is offset from the force line. The at least one opening may be two openings configured for receiving two fingers of the user's hand, and the at least one extension may be configured for contacting a thumb of the user's hand after the two fingers are inserted.

The strike portion may be a strike plate formed from a resilient material or metal. The impact portion may be a removable tip having an end shape selected from the group consisting of rounded, flat, beveled, pointed and a combination thereof.

The at least one opening may be one opening centered on the force line, where the at least one extension includes two extensions that extend symmetrically relative to the force line.

The at least one opening may be defined by at least one recess and a flexible band spanning the at least one recess.

In another aspect of the invention, a punch tool includes a strike portion centered on a force line, the strike portion comprising a material configured for striking with an external force; an impact portion disposed below the strike portion and concentric with the force line, the impact portion having an end tip configured to focus at least a portion of an external force to a target on a work surface; and a tool body having at least one opening for receiving a user's digit, the body disposed between the strike portion and the impact portion, the tool body configured to receive the user's digit to position and support the impact portion at the target while maintaining a distance from the strike portion to avoid impacting the user's hand. In some embodiments, the at least one opening is centered on the force line. The at least one opening may include two openings configured for receiving two fingers of the user's hand. The strike portion may be formed from a resilient material or may be a metal plate. The impact portion may be a removable tip having an end shape selected from the group consisting of rounded, flat, beveled, pointed and a combination thereof.

In some embodiments, the at least one opening is one opening disposed offset from the force line. In other embodiments, the strike portion and the impact portion may have a shaft disposed therebetween, which is attached to the tool body by a pivoting connector connecting the shaft to the tool body.

BRIEF DESCRIPTION OF THE DRAWINGS

FIG. 1 is a perspective view of a first embodiment of a punch tool according to the invention.

FIG. 2A is an exploded side view of the first embodiment of a punch tool; FIG. 2B is a side view of the tool body of FIG. 2A; FIG. 2C is a side view of a tip extender according to an embodiment of the invention.

DETAILED DESCRIPTION OF EXEMPLARY EMBODIMENTS

Figure 3A:
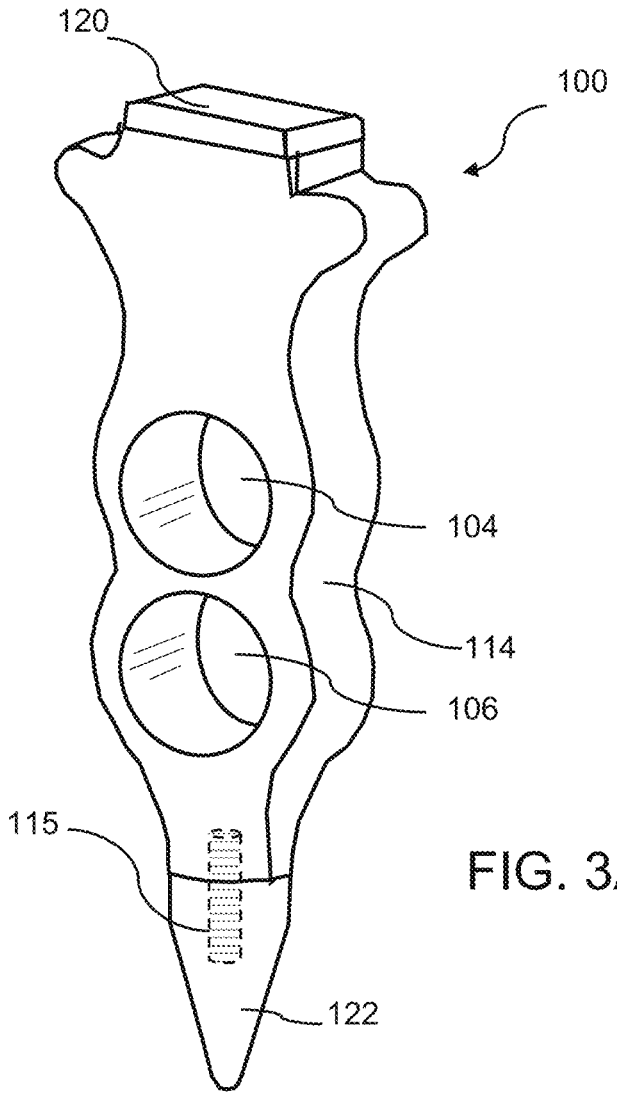
FIG. 3A is a perspective view of the first embodiment of a punch tool including a tip and strike pad.

In an exemplary embodiment, a punch tool includes a body having a contoured profile configured for holding in a user's hand, a strike portion having a surface for applying an external force, an impact portion configured for contacting the work surface, and at least one opening configured for insertion of one or more of the user's digits. The contoured profile includes tapered extensions and recessed surfaces to facilitate gripping with the user's hand. The tool body may be formed from a plastic or polymer, metal, wood, or any other material that is sufficiently rigid to tolerate impact of varying force and to transfer the force from one end to the other. The strike portion may include a recessed area for receiving a strike pad, which may be permanently or removably attached to the strike portion. The strike pad may be formed from a resilient material such as an elastomer, a polymer or plastic, wood, cork, or it may be a hard material, i.e., a metal plate, such as steel. A force line extends between the strike portion and the impact portion, so that application of a force to the strike portion transfers force to the impact portion, which, in turn, focuses the force on the target point on the work surface. The impact portion may be a tip removably attached to the body. The tip may be cylindrical, conical, pointed, rounded, or some combination thereof, depending on the desired use. In some embodiments, the force line extends through the at least one hole in the body, while in other embodiments, the force line is offset from the at least one hole.

In the embodiment shown in FIGS. 1-3A, the tool body 100 is generally planar with a contoured profile having rounded extensions 102 to provide a gripping surface for a user's hand. The corners and edges of the tool are preferably beveled or curved for avoid sharp edges and for enhanced comfort. Finger openings 104 and 106 are provided for insertion of the user's digits (fingers and/or thumb) of the hands. For a two opening embodiment, the digits typically used will be the user's index ($2^{nd}$) and middle ($3^{rd}$) fingers, however, the middle and ring ($4^{th}$) finger may also be used. The divider 103 between openings 104 and 106 separates the user's fingers, improving comfort and reducing the risk of injury, while providing enhanced grip. In other embodiments, three or four openings may be provided for insertion of three or four digits simultaneously, or to allow the user to vary which openings are used with one, two or three digits to facilitate access based on the approach angle to the target point. The indented (recessed) portions 112 below the extensions 102 and the indented portions 114 provide thumb contact surfaces, with the user selecting the appropriate location for placement of the thumb based on which fingers have been inserted through the openings 102 and 104. The sizes of openings as well as the overall dimensions of the tool body may be varied based on the user's finger and hand sizes as well as the type of work to be performed.

Strike portion 108 at the upper portion of the tool body provides the location at which an external force may be applied to the tool along force line 10. In some embodiments, the strike portion 108 provides a surface for attachment of a strike plate, such as plate 120 shown in FIGS. 2A and 3A.

The strike plate 120 may be formed from a resilient material, including rubber, elastomer, cork, silicone, or similar material. Strike plate 120 may be positioned within a slightly recessed area defined in the upper portion of the tool body by ridges 105. Attachment of the strike plate may be achieved using an adhesive or by forming the plate with bosses extending therefrom that can be inserted into corresponding bores in the upper surface of the strike portion using an interference or compression fit. Alternatively, the strike plate 120 may be attached via screws or pins (not shown) inserted through countersunk holes 136 and into threaded bores 138 in the tool body so that the screw heads are well recessed from the actual strike surface. A resilient material would generally be preferred for purposes of paintless dent removal, where the source of the impact may range from the user hitting the strike plate with the heel of his or her hand or using a mallet or other tool. Where the user is applying the force with their other hand, it would generally be desirable to use a softer material, e.g., elastomer or cork, to avoid injury to the striking hand. In uses for leather or wood working, where is hammer is being used to apply force, the strike plate may preferably be metal.

FIG. 2A provides an exploded view of an embodiment of the punch tool showing the interchangeable tip attachment. Optional tool tip extension 130 may be attached to the tool 100 by a screw, bolt, threaded rod 115 or other appropriate fastener inserted into a bore 116 in the lower portion 110 of the tool. For a threaded fastener, opening 116 may have internal threads for receiving a screw/bolt/threaded rod that also screws into bore 132 in tip extension 130. A long screw/bolt/threaded rod that extends through the entire length of the extension may then be used to attach the tip 118 by inserting the screw/bolt into threaded bore 134 in tip 118. Alternatively, the extension 130 may be fitted with a separate screw extending from its lower end to mate with bore 134 in tip 118. FIG. 2B illustrates such an embodiment, with extender 150 having a threaded bore 152 at its upper end configured to mate with a screw/bolt/threaded rod extending from the bottom 110 of tool 100, and a separate screw/bolt/threaded rod 154 sized to fit into and attach a tip. As will be readily apparent to those in the art, a number of extenders 150 with different lengths may be included in a commercial kit that may also include a variety of different tip attachments.

In other embodiments that may be appropriate for driving nails and other fasteners into a material, or for punching, patterning or cutting leather, the strike plate 120 would preferably be a hard surface, e.g., a metal such as steel or aluminum. In this case, the strike plate 120 may be attached via screws inserted through countersunk holes and into threaded bores in the tool body. In still other embodiments, the tool body may be formed from a material that is sufficiently durable to receive the direct impact of the source of the force, with or without a separate strike plate. For example, the tool body may be formed from metal, as a conventional punch, but with an enhanced grip provided by finger holes and surface contours as described herein.

Figure 3B:
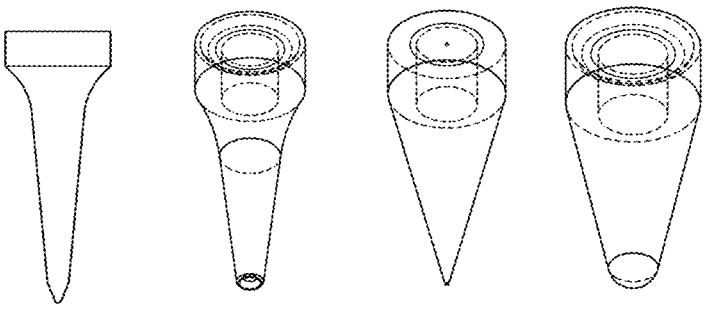
FIG. 3B illustrates several examples of tip configurations.

An exemplary impact tip 122 with a rounded end is shown in FIG. 3A. In the preferred embodiments, the tip will be interchangeable to provide different degrees of spreading of the applied force. Tip 118 shown in FIG. 2 has a flat end. Tips with different diameters at the flat end may be provided, as well as tips with a combination of flat and beveled edges. Rounded tips, such as tip 122 shown in FIG. 3A, may have different radii for different operations. FIG. 3B illustrates a small number of examples of tip configurations that may be used. From left to right, tips shown are an awl, a flat tip such as might be used for a nail punch, a pointed tip, and a rounded tip. Ideally, a commercial kit with a wide variety of tip shapes and diameters, as well as the optional extenders as described above, may be assembled to allow the tool user to obtain the desired effect as needed for the surface to be worked. Depending on the application of the tool, the tip may be formed from a variety of different materials including metal, polymer, plastic, hard rubber, wood, ceramic, or other appropriate material.

Figure 4:
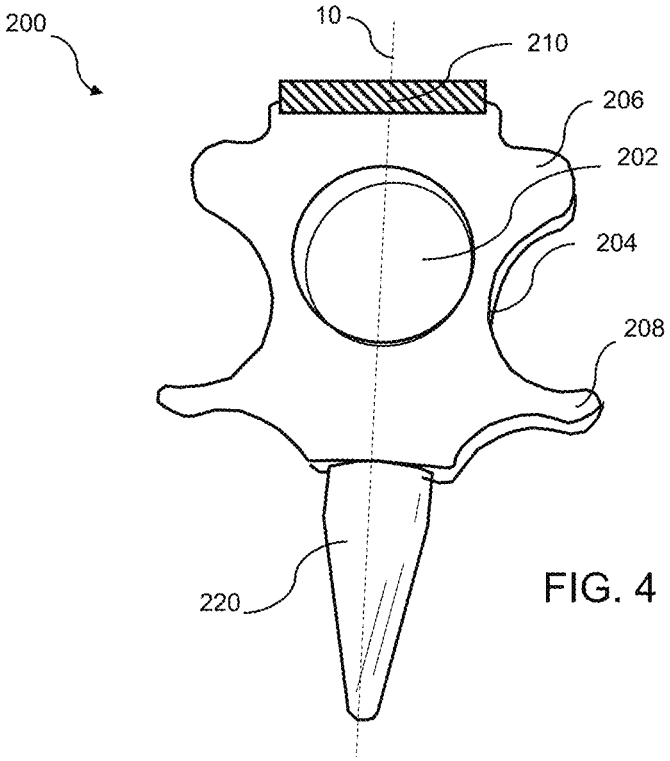
FIG. 4 is a side view of a second embodiment of a punch tool.

FIG. 4 illustrates a second embodiment of the punch tool 200 with a contoured body profile having a single finger hole 202 centered between two side recesses 204 defined by extensions 206 at the top of each recess and extensions 208 at the bottom of the recess. Note that these extensions extend symmetrically relative to the force line. The strike portion 210 and the impact portion (tip 220) are located above and below the finger hole 202, respectively. In this embodiment, the user may insert the index finger through the hole, placing the thumb and third fingers on the side recesses 204, and, where needed, applying downward force (along force line 10) to the upper surfaces of lower extensions 208. Holding the tool in this manner would allow the user to apply an impact force to a work surface perpendicular to his or her palm. Another use would be to insert the middle finger through the hole and place the index and ring fingers at the side recesses. This position would allow the user to apply an impact force to a work surface parallel to the palm. As in the first embodiment, tip 220 may be interchangeable by using a releasable fastener for attaching the tip 220 to the lower portion of the punch tool. In an alternative configuration, the tip and punch tool may be integrally formed as a single piece, for example, by molding both the body and tip from a high impact plastic, or by machining or molding a metal. In some embodiments, the strike portion 210 may have a separate strike material such as metal, plastic, rubber, elastomer or cork, attached using an adhesive, screws or other fasteners. Selection of an appropriate strike material to control the amount of force transferred to the punch tool will be within the level of skill in the art. A commercial kit with interchangeable tips and extenders may also include a variety of different strike materials that can be interchangeably attached for different applications.

Figure 5:
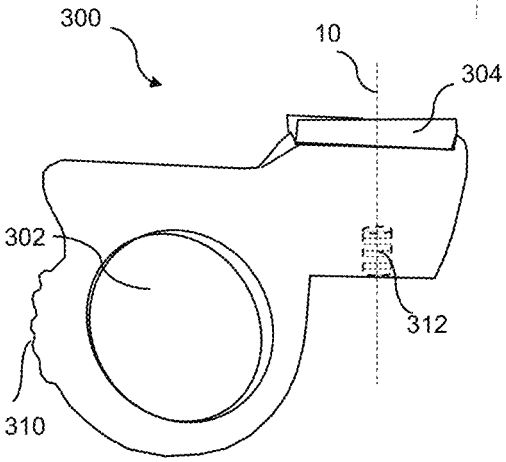
FIG. 5 is a side view of a third embodiment of the punch tool with an offset finger hold and ridged grip surface.
Figure 6:
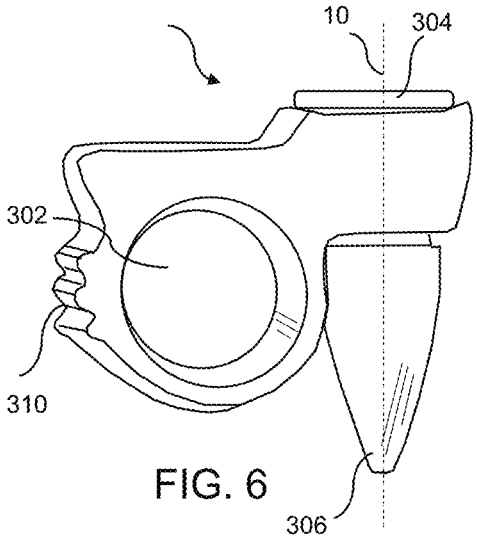
FIG. 6 is side view of a third embodiment of the punch tool with an offset finger hold and ridged grip surface.

FIGS. 5 and 6 illustrate still another embodiment of the inventive punch tool design 300 with a contoured body having a single finger hole 302 that is offset from the force line 10 the extends between the strike portion 304 and the impact portion (tip 306). In this embodiment, the user may insert his or her index finger through the opening 302, placing the thumb over the ridges 310 on the outer surface of the ring for firm support. The finger opening 302 may be oval or oblong for improved comfort and control. As in the other embodiments, the impact tip 306 may be interchangeable by inserting a threaded fastener into bore 312, which is concentric with force line 10. In some implementations, the tool handle and tip may be integrally formed from a single material, as described above, but molding or machine plastic or metal. The strike surface at strike portion 304 may optionally be formed by attaching a separate material such as metal, plastic, rubber, cork, etc.

Figure 7:
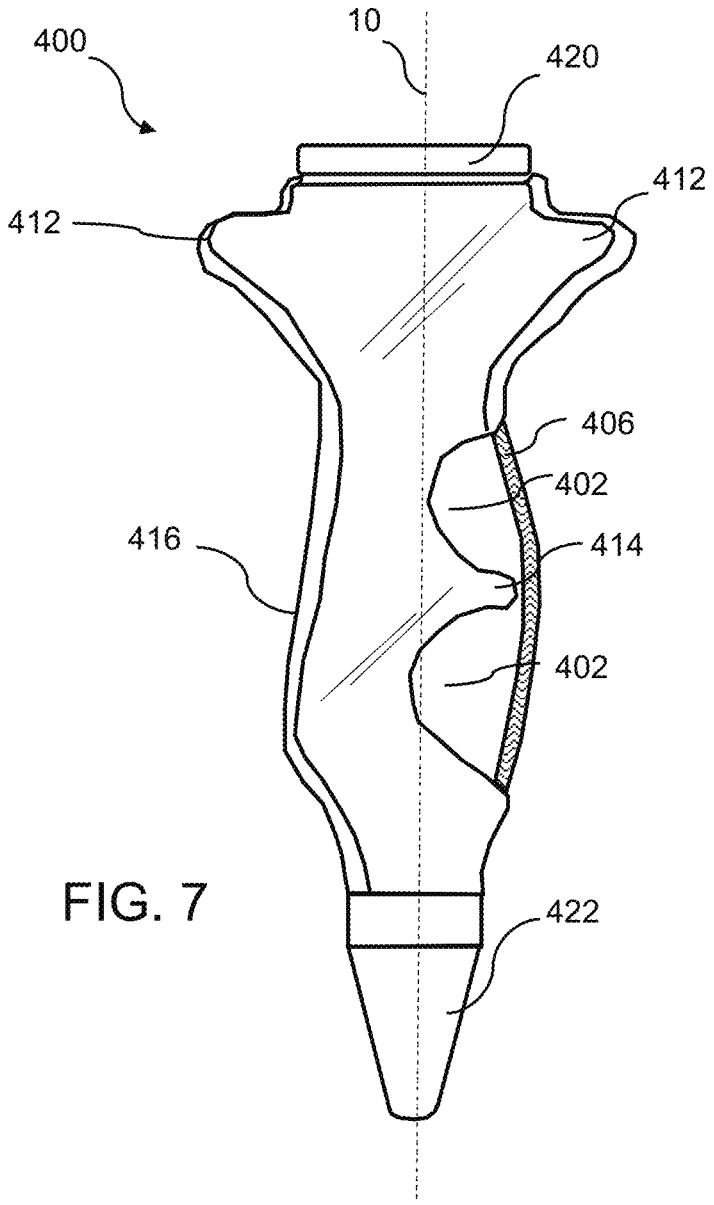
FIG. 7 is a side view of a fourth embodiment of the punch tool with a finger hold with a side band.

FIG. 7 illustrates yet another embodiment of the punch tool 400 in which the finger openings are defined by a combination of recesses 402 and a flexible band 406 that spans the recesses. The band 406 may be elastic, rubber, woven or braided nylon or cotton, or some other material that supports the tool on the user's hand after the user has inserted his or her fingers between the recesses 402 and the band 406. The band material will preferably be resilient to provide a good fit to the user's hand to avoid slippage or dropping. For use of this embodiment, the user would typically insert his or her index and middle finger into recesses 402 while applying the thumb to the opposite surface 416 on the body profile or to extension 412, depending on the approach angle. As in the previously-described embodiments, extensions 412 facilitate positioning and gripping of the tool, while extension 414 assists the user in applying downward pressure to the tool with his or her fingers while securely holding the tool. (It may be noted that extension 414 also keeps the user's fingers separated to enhance comfort and reduce fatigue.) Strike portion 420 and impact portion (tip 422) are aligned with the force line 10 as in the other embodiments. The tip 422 may be removable or may be integrally formed with the tool body. An advantage of this embodiment is that it allows use of the same tool by persons with different hand sizes.

Figure 8A:
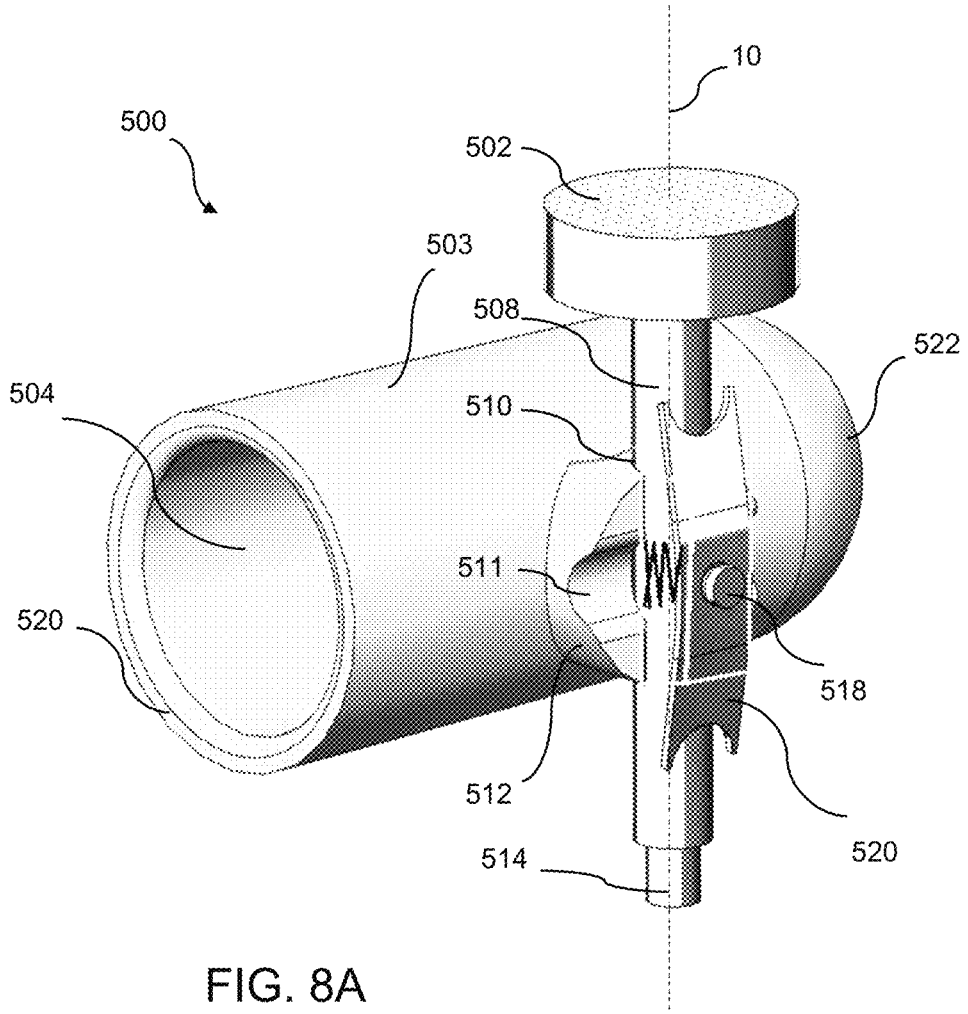
FIG. 8A is a perspective view of a fifth embodiment of a punch tool.
Figure 8B:
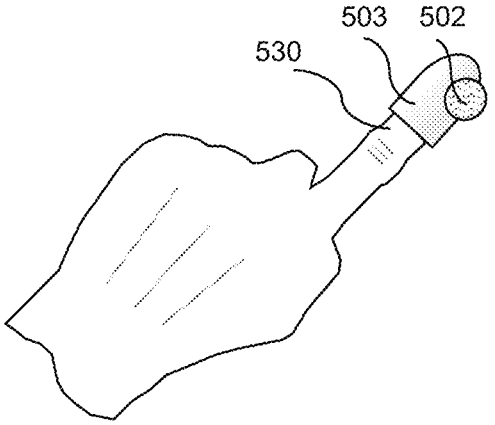
FIG. 8B illustrates the embodiment of FIG. 8A on a user's hand.

The punch tool embodiment 500 of FIGS. 8A and 8B employs the same basic principles of the above-described embodiments. The opening 504 for insertion of a user's finger is defined by a cylindrical body 503. The end 522 of body 503 opposite opening 504 may be closed to provide additional protection for the user's finger as well as increasing the strength of the structure. As shown in FIG. 8B, the body 503 is configured to fit over the end of the user's finger 530 and extend to a point about halfway between the distal and proximal interphalangeal joints. The edge 520 of opening 504 is preferably beveled or rounded. A padding material may be attached near edge 520 for additional comfort.

Strike surface 502 at the upper part of the tool and impact point 514 at the lower part of the tool are centered along force line 10 when the tool is configured for use. As in the embodiments of FIGS. 5 and 6, the finger opening is offset from the force line 10. Strike surface 502 is positioned on a shaft 508, also centered along force line 10.

In some embodiments, the shaft 508 may be permanently affixed in a position that is perpendicular to the axis of body 503, allowing the user to position his or her finger immediately to the side of the point on the work surface to be impacted.

In the illustrated embodiment, the shaft 508 is attached to body 503 by way of a pivot pin 518 and supported within channels formed in a boss 512 mounted on the outer side of body 503. Channel 510 in boss 512 extends perpendicular to the body axis, while channel 511 runs parallel to the body axis. For storage, shaft 508 is rotated parallel to the body axis to be retained within channel 511. To configure for use, the shaft 508 is pulled away from the body 503 to overcome the spring force of spring clip 520, allowing rotation of the shaft around pivot pin 518. The shaft 508 is rotated until it aligns with channel 510, i.e., 90° either clockwise or counterclockwise, and the pulling force is released, allowing the spring force to pull the shaft securely into channel 510. The ability to rotate the shaft 508 relative to the body 503 allows the user to adjust for left or right handed use as well as for placement of the user's hand to the left or right of the target point on the work surface. This provides the versatility needed for working in tight or awkward positions. After use, the shaft may again be rotated by pulling it away from the body to align the shaft with channel 511 for storage.

Based on the described and illustrated examples, it will be apparent to one of skill in the art that other configurations, e.g., combinations of one or more finger holes and surface recesses for gripping a tool with a strike surface and an impact surface, can be devised to achieve different functions for transferring force to a work surface.

The punch tool according to the present invention provides numerous advantages over prior art punch tools used in the fields of paintless dent removal, construction, cabinetry, wood working and leather working, among other areas. Stability, safety, maneuverability and comfort of use are greatly improved with the gripping features, while fatigue during extended and/or repeated use are reduced or eliminated. The tools are versatile and would preferably be provided in a kit or set with a variety of different configurations and tips to allow the user to apply the desired force from virtually any angle and orientation relative to the user's hand.

The foregoing description and accompanying drawings provide a number of illustrative examples of punch tools that incorporate the principles of the invention. These examples are not intended to limiting, and it will be readily apparent to those in the art that different permutations and combinations of the features described herein may be made that still fall within the scope of the invention.

The invention claimed is:

1. A punch tool comprising:

a strike portion centered on a force line, the strike portion having a strike surface area comprising a material configured for striking with an external force;

an impact portion disposed below the strike portion and concentric with the force line, the impact portion having an end tip having a contact surface area smaller than the strike surface area configured to focus at least a portion of an external force to a target on a work surface; and a planar tool body having a body thickness with at least one opening therethrough for receiving one or more of a user's digits, the tool body having a contoured profile comprising an upper portion having at least one extension, wherein a combined width of the upper portion and the at least one extension is wider than the strike portion, a center portion having at least one indentation, and a lower portion, the tool body disposed between the strike portion and the impact portion wherein the force line passes through the at least one opening, the tool body configured to receive the one or more of the user's digits to position and support the impact portion in contact with the target while maintaining a distance from each of the strike portion and the impact portion to avoid impacting the user's hand when the user applies the external force to the strike area.

2. The punch tool of claim 1, wherein the at least one opening is centered on the force line.

3. The punch tool of claim 1, wherein the at least one opening comprises two openings configured for receiving two fingers of the user's hand.

4. The punch tool of claim 1, wherein the strike portion comprises a strike plate formed from a resilient material.

5. The punch tool of claim 1, wherein the strike portion comprises a metal plate.

6. The punch tool of claim 1, wherein the impact portion comprises a removable tip having an end shape selected from the group consisting of rounded, flat, beveled, pointed and a combination thereof.

7. The punch tool of claim 1, further comprising at least one second extension extending near the lower portion of the body, the at least one second extension configured for contacting a thumb of the user's hand after the one or more of the user's digits are inserted.

8. A punch tool comprising:

a planar body having a body thickness and a contoured profile having an upper portion, a center portion, and a lower portion, the center portion having at least one opening extending through the body thickness and centered within the contoured profile, wherein the upper portion of the contoured profile comprises at least one extension and the center portion of the contoured profile comprises at least one indentation;

a strike portion disposed at the upper portion of the body centered on a force line extending through the body, the strike portion having a strike surface area comprising a material configured for striking with an external force to transfer an impact force into the body along the force line to the lower portion, wherein the strike portion has a width narrower than a combined width of the upper portion and the at least one extension; and an impact portion disposed at the lower portion of the body, the impact portion concentric with the force line and having an end tip having a contact surface area configured to focus at least a portion of the impact force to a work surface;

wherein the body is configured for inserting one or more of a user's digits into the at least one opening, contacting the at least one indentation with another of the user's digits to stably position the impact portion at a target location on the work surface, and striking the strike portion with the external force to transfer impact force to the target location, wherein the at least one extension is configured to at least partially shields the user's digits from the external force.

9. The punch tool of claim 8, wherein the at least one opening is centered on the force line.

10. The punch tool of claim 8, wherein the at least one opening comprises two openings configured for receiving two of the user's digits.

11. The punch tool of claim 8, further comprising at least one second extension extending from the lower portion of the body, the at least one second extension configured for contacting a thumb of the user's hand after the one or more of the user's digits are inserted.

12. The punch tool of claim 8, wherein the strike portion comprises a strike plate formed from a resilient material.

13. The punch tool of claim 8, wherein the strike portion comprises a metal plate.

14. The punch tool of claim 8, wherein the impact portion comprises a removable tip having an end shape selected from the group consisting of rounded, flat, beveled, pointed and a combination thereof.

15. The punch tool of claim 8, wherein the at least one opening comprises one opening centered on the force line, and wherein the at least one extension comprises two extensions that extend symmetrically relative to the force line.

16. The punch tool of claim 8, wherein the at least one opening is defined by at least one recess and a flexible band spanning the at least one recess.

17. The punch tool of claim 16, wherein the at least one opening comprises two recesses.

* * * * *